US006098749A

United States Patent [19]

Enochs

[11] Patent Number: 6,098,749

[45] Date of Patent: Aug. 8, 2000

[54] WORK HOLDER

[76] Inventor: William R. Enochs, 9780 Conrad Rd., Harrisburg, Mo. 65256

[21] Appl. No.: 09/289,304

[22] Filed: Apr. 9, 1999

[51] Int. Cl.[7] ..... E04G 1/00; E04G 3/00; E04G 3/08

[52] U.S. Cl. ..... 182/129; 248/238

[58] Field of Search ..... 182/129, 121, 182/141; 248/210, 238

[56] References Cited

U.S. PATENT DOCUMENTS

| | | | |
|---|---|---|---|
| 1,376,924 | 5/1921 | Dixson | 182/121 |
| 3,139,154 | 6/1964 | Ewald | 182/129 |
| 3,208,555 | 9/1965 | Fry | 182/129 X |
| 3,490,558 | 1/1970 | Foley | 182/129 |
| 5,120,013 | 6/1992 | Sweeney | 182/129 X |
| 5,544,718 | 8/1996 | Schumacher | 182/129 |
| 5,584,357 | 12/1996 | Gugel et al. | 182/129 |
| 5,622,463 | 4/1997 | Testa | 182/129 X |
| 5,740,883 | 4/1998 | Trank | 182/129 |
| 5,913,380 | 6/1999 | Gugel et al. | 182/129 |

FOREIGN PATENT DOCUMENTS

| | | | |
|---|---|---|---|
| 680931 | 10/1952 | United Kingdom | 182/129 |

*Primary Examiner*—Daniel P. Stodola
*Assistant Examiner*—Hugh B. Thompson
*Attorney, Agent, or Firm*—Polster, Lieder, Woodruff & Lucchesi, L.C.

[57] ABSTRACT

A work holder is adapted to be removably mounted on a scaffold that has vertically spaced, horizontally disposed cross members. The work holder has a base frame including spaced, parallel, vertically elongated receivers, and mounting brackets carried by the base frame near an upper end of the base frame, the brackets being adapted to engage a horizontal cross member of the scaffold and to support the base frame against both downward and outward displacement. Vertically elongated extendable members are slidably mounted on the spaced parallel base members for movement lengthwise thereof. Clamps are provided for holding the extendable members in selectable positions with respect to the base member. A work holder is mounted on the elongated extendable members, at an upper ends of the extendable members.

8 Claims, 2 Drawing Sheets

WORK HOLDER

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Workers, such as painters or installers of drywall panels, who must work on scaffolding, need a place for tools, paint, or other work elements, to be held at a convenient height.

One of the objects of this invention is to provide a work holder that is adjustable vertically to accommodate different workmen and different needs.

Other objects will become apparent to those skilled in the art in the light of the following description and accompanying drawing.

BRIEF SUMMARY OF THE INVENTION

In accordance with this invention, generally stated, a work holder is provided, adapted to be removably mounted on a scaffold, the scaffold having vertically spaced, horizontally disposed cross members. The holder includes a base frame with spaced parallel vertically elongated receivers, and mounting brackets carried by the base frame near an upper end of the frame. The brackets are adapted to engage a horizontal cross member of the scaffold and to support the base frame against both downward and outward displacement with respect to the scaffold. Vertically elongated extendable members are slidably mounted on the spaced parallel base members for movement lengthwise thereof. Clamp means are provided for holding the extendable members in selected positions with respect to the base member, and a work holder is mounted at an upper end of the extendable members. In the preferred embodiment, the parallel vertically elongated members are open ended tubes, and the extendable members are shaped complementarily in cross section and are closely but slidably mounted in the receivers. The clamp means are spring clamps of the type in which a pair of handles, when squeezed, increase the diameter of a spring to permit the clamp to be moved along the extendable members. In this embodiment, the base frame includes cross members, a lower of which carries a J bolt with a threaded shank and a hook at the lower end of the shank. The J bolt is so mounted that by running a nut down the threaded section, the J bolt can be moved vertically. The work holder is a plastic basket with an integral socket into which upper ends of the extendable members are fitted.

In use, the brackets carried by the base frame are hooked over a cross member of the scaffold, and the J bolt is hooked under a cross member of the scaffold below the cross member to which the brackets are mounted. The elongated extendable members are then slid upwardly to the desired height, and the clamps are moved to engage the upper end of the receivers, and released to tighten around the extendable members, to hold the extendable members, hence the work basket, in the desired position.

DETAILED DESCRIPTION OF THE INVENTION

Figure 1:
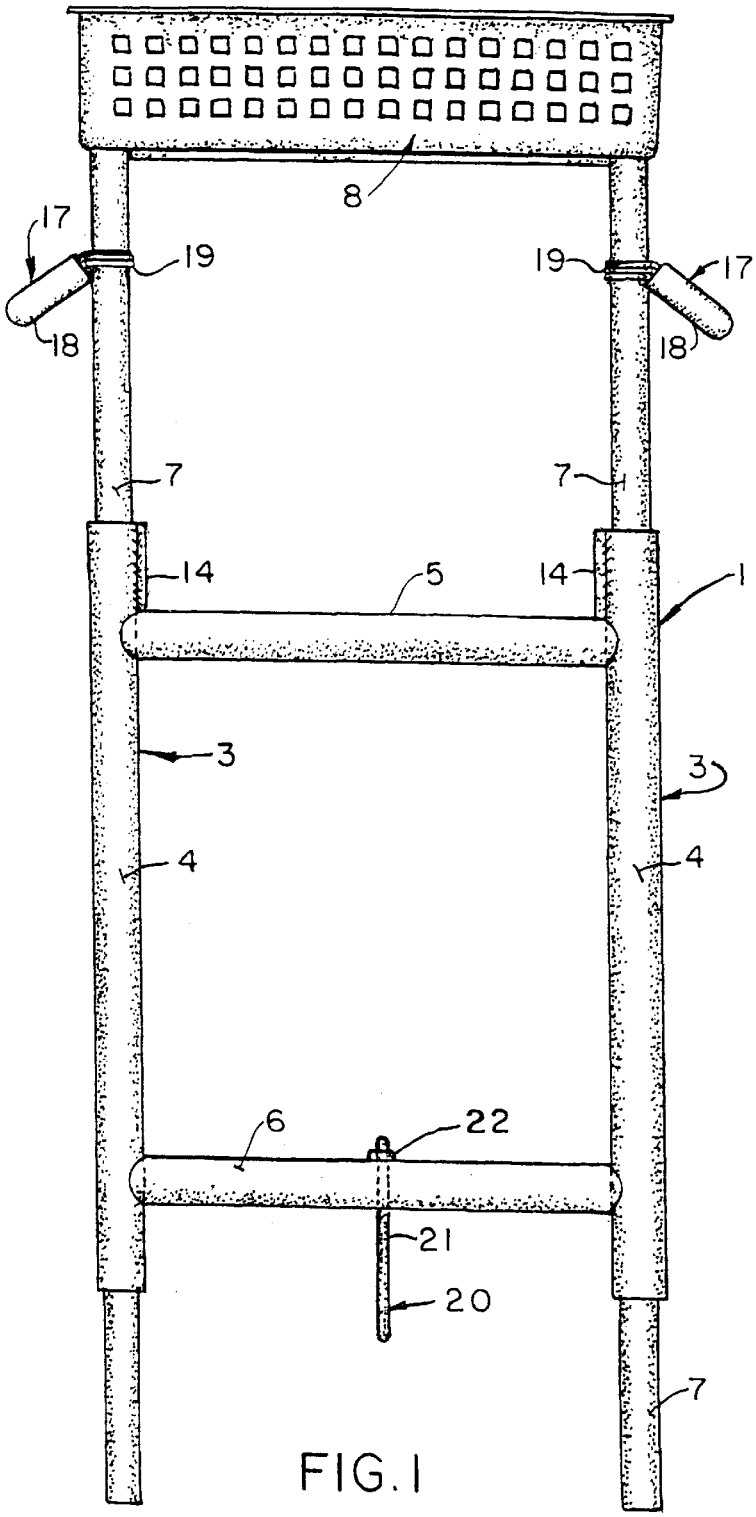
FIG. 1 is a view in front elevation of one illustrative embodiment of the work holder of this invention.
Figure 2:
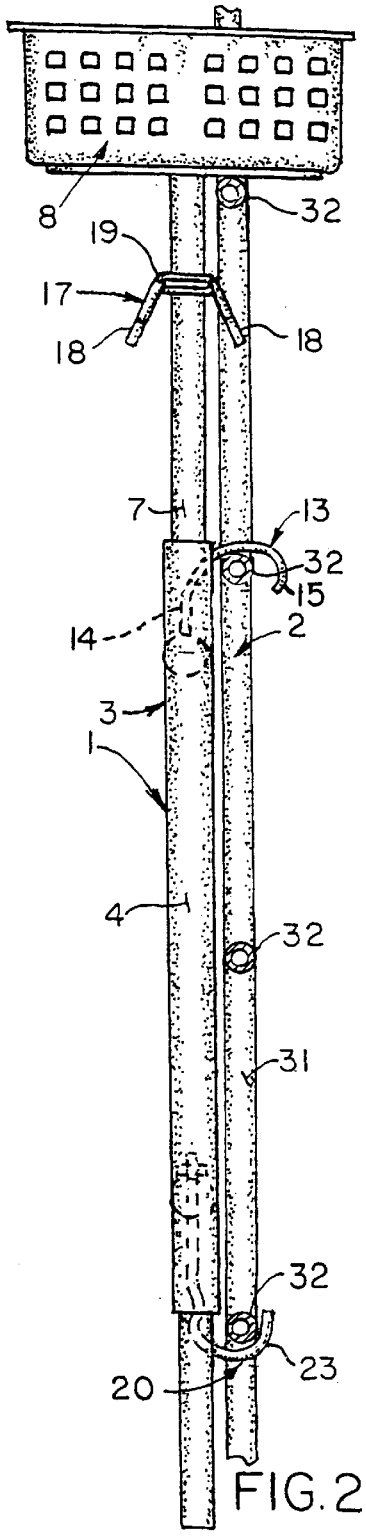
FIG. 2 is a view in side elevation of the work holder shown in FIG. 1, with scaffolding shown fragmentarily.
Figure 4:
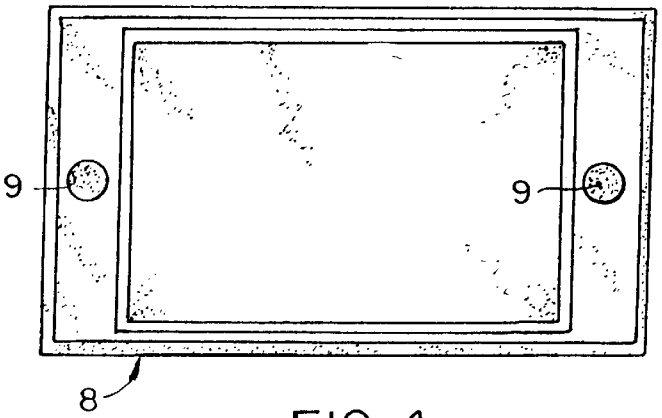
FIG. 4 is a bottom plan view of the workbasket shown in FIG. 3.
Figure 3:
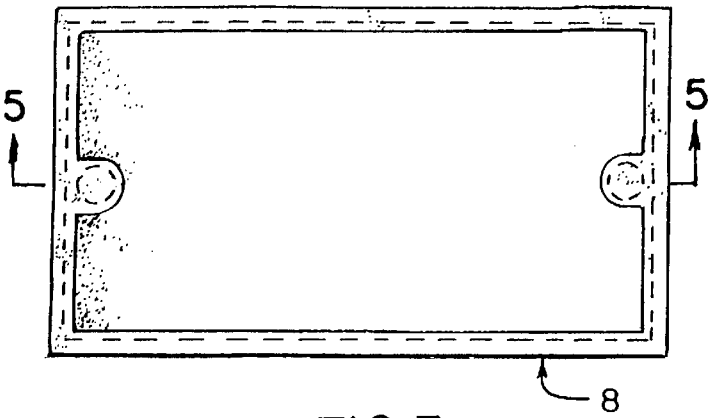
FIG. 3 is a top plan view of a work basket.
Figure 6:
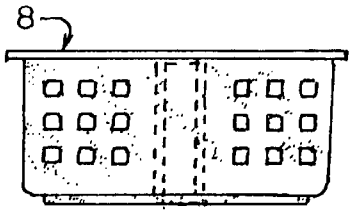
FIG. 6 is an end view of the work basket shown in FIG. 5.
Figure 5:
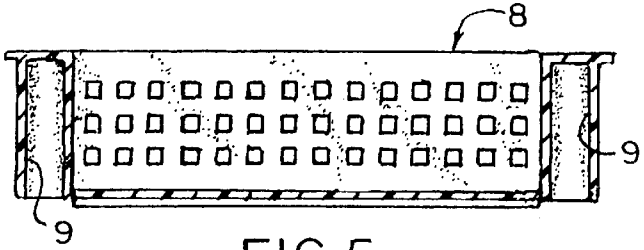
FIG. 5 is a sectional view taken along the line 5—5 of FIG. 3.
Figure 7:
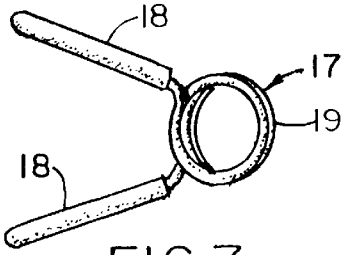
FIG. 7 is a view in perspective of one type of clamp useful in the present invention.

Referring now to the drawing for one illustrative embodiment of this invention, reference numeral 1 indicates a complete holder, which, in FIG. 2, is shown mounted on a scaffold 2. The scaffold 2 has the usual vertical supports 31, and cross members 32, which conventionally are spaced vertically about one foot apart.

In this embodiment, the work holder is made up of a base frame 3, made up of tubular, open-ended receivers 4, connected by an upper cross bar 5 and a lower cross bar 6, extendable members or slides 7, and a work basket 8, into sockets 9 of which upper ends of the slides extend. Spring clamps 17 are mounted on the slides 7. The spring clamps 17 have handles 18 which, when squeezed toward one another, enlarge a helical spring 19 of the spring clamp to permit its being moved manually along the slide 7.

Brackets 13 have a stem 14 and a hook part 15. The stems of the two brackets are welded to facing surfaces of the receivers 4 at the upper end of the receivers. The hook part 15 extends around a cross bar 32 of the scaffold sufficiently far to ensure that if a worker tending to fall backward grabs any part of the holder, it will not be dislodged from the cross bar 32.

In the embodiment shown, the basket is made of a high impact plastic, and the sockets are molded integrally with the rest of the basket.

In this embodiment, a passage is made, extending vertically, through the lower cross bar 6, and a J-hook 20, with a shank 21 threaded through a portion of its upper reach, extends. The J-hook has a hook part 23 that, when the J hook is in position, engages the underside of immediately adjacent scaffold cross member or rung 32 (shown in FIG. 2). To this end, a nut 22 on the threaded section of the J hook, is backed off to permit the hook part 23 to pass beneath the cross bar, and is then tightened until the hook part embraces the cross bar 6. When the base frame has been mounted to the scaffold, the slides 7 are slid upwardly to the desired height of the work basket, and the clamps 17 are moved down until they engage the upper surface of the receivers 4, to hold the slides, hence the work basket, in the desired position. Thus, the work basket can be positioned at a height to accommodate different workmen, and to accommodate work elements that may be put into the basket. For example, for a painter, a basket holding paint and brush-holders may be set at a different height from a basket containing the tools of a drywall installer.

In the illustrative embodiment shown, the basket in FIG. 2 is shown as resting on a cross member 32 of the scaffold. If it is desired to be able to adjust the height of the basket infinitely through the reach of the slides 7, the bracket member 13 and the J-hook 20 can be designed to hold the work holder far enough away from the scaffold to let the basket clear, or the basket can be made asymmetrical so as to clear the cross members 32.

Numerous variations in the construction of the work holder of this invention, within the scope of the appended claims, will occur to those skilled in the art in light of the foregoing disclosure. Merely by way of example, the receivers 4 may be made square in cross section, and the slide 7, complementarily shaped. The receivers can even be channels or flat shapes, and the slides similarly formed, with the clamping means, for example, in the form of bolts extending through elongated slots in either the receiver or the slide, with wing nuts to tighten the slides in place. The clamping means can also be varied, taking the form of C-clamps or even holes through the slides 7 into which pins or bolts can be inserted. However, the spring clamps illustrated are a simple and effective means of clamping the slides 7 in the desired position. The work holder can be an unperforated or perforated sheet metal or wire basket, with the upper ends of the slides 7 welded or otherwise secured thereto. A strap with a suitable buckle can be used in lieu of the J-hook 20. Such a strap should preferably be inelastic, so that the frame does not move away from the scaffold if a workman should grab the crossbar 6. The holder can be made of any suitable material, including wood, if the base frame vertical members are made flat. The mounting brackets can take other forms such as a single, elongated hook-shaped plate in extending a substantial distance along the upper cross bar of the base frame. All of these variations are merely illustrative.

What is claimed is:

1. A work holder adapted to be removably mounted on a scaffold having vertically spaced, horizontally disposed cross members, said holder comprising a base frame including spaced, parallel, vertically elongated, open-ended tubular receivers; an upper cross bar extending between and secured at two ends thereof to said receivers near an upper end of said receivers, upper downwardly opening hooks mounted on said receivers near an upper end of said receivers, extending above said upper cross bar, said hooks being adapted to engage an upper horizontal cross member of said scaffold to support said base frame against downward and outward displacement from said scaffold; vertically elongated extendable members slidably mounted in said receivers for movement lengthwise thereof; means for holding said extendable members in selected positions with respect to said receivers, a lower cross bar extending between and secured at two ends thereof to said receivers near a lower end of said receivers, an upwardly opening lower hook mounted on said lower cross bar and adapted to engage a lower cross member of said scaffold below the cross member engaged by said upper hooks, said lower hook being adapted to be movable between a position below said lower cross member and a position at which said lower cross member, and a work basket mounted on said extendable members.

2. The holder of claim 1 wherein the receivers are open ended tubes, and said extendable members are tubes closely but slidably received in said receivers.

3. The holder of claim 2 wherein the means for holding the extendable members are spring clamps mounted on said extendable members.

4. The holder of claim 1 wherein said lower hook is an open-topped J-hook having a threaded shank extending upwardly through a passage in said lower cross bar and a nut on said threaded shank by which said hook can be moved downwardly to clear said lower cross member and moved upwardly to engage said lower cross member.

5. A work holder adapted to be removably mounted on a scaffold having vertically spaced, horizontally disposed cross members, said holder comprising a base frame including spaced, parallel, vertically elongated open-ended tubular receivers; an upper cross bar extending between and secured at two ends thereof to said receivers near an upper end of said receivers, downwardly opening hooks mounted on said receivers near an upper end of said receivers, extending above said upper cross bar, said hooks being adapted to engage an upper horizontal cross member of said scaffold to support said base frame against downward and outward displacement from said scaffold, vertically elongated extendable members slidably mounted in said receivers for movement lengthwise thereof means for holding said extendable members in selected positions with respect to said receivers, a lower cross bar extending between and secured at two ends thereof to said receivers near a lower end of said receivers, lower holding means mounted on said lower cross bar and adapted selectively to engage a lower cross member of said scaffold below the cross member engaged by said upper hooks, and a work basket mounted on said extendable members.

6. The work holder of claim 5 wherein said lower holding means comprises an upwardly opening J-hook with a threaded shank, said shank extending upwardly through a passage in said base frame lower cross bar, said J-hook upwardly opening hook part being adapted to engage a cross member of said scaffold to prevent displacement of said holder from said scaffold, and a nut on said threaded shank above the lower cross bar, whereby the hook part of said J-hook can be positioned to clear a cross member of said scaffold below the cross member engaged by the mounting brackets by loosening the nut, and subsequently raised to engaging position by tightening the nut.

7. The work holder of claim 5 wherein the work basket is made of plastic.

8. The work holder of claim 7 including sockets, integral with said plastic basket, into which upper ends of said extendable members extend.

* * * * *